US005675955A

United States Patent [19]

Champagne

[11] Patent Number: 5,675,955

[45] Date of Patent: Oct. 14, 1997

[54] SYSTEM FOR COVERING EXTERIOR BUILDING SURFACES

[76] Inventor: Wendel James Champagne, 21823 W. Champagne Cir., Tomball, Tex. 77375

[21] Appl. No.: 522,609

[22] Filed: Sep. 1, 1995

[51] Int. Cl.[6] ..... E04D 1/00; E04D 1/34

[52] U.S. Cl. ..... 52/521; 52/519; 52/520; 52/522; 52/539; 52/542; 52/545; 52/552; 52/747.1; 52/748.11

[58] Field of Search ..... 52/519–522, 539, 52/541, 542, 544–547, 557, 552, 716.8, 745.06, 745.2, 748.1, 748.11, 745.1, 747.1

[56] References Cited

U.S. PATENT DOCUMENTS

| | | | |
|---|---|---|---|
| 2,427,762 | 9/1947 | Carr | 52/547 X |
| 2,820,535 | 1/1958 | Hutchison | 52/520 |
| 3,289,365 | 12/1966 | McLaughlin et al. | 52/521 X |
| 3,325,952 | 6/1967 | Trachtenberg | 52/521 X |
| 3,703,062 | 11/1972 | McKinney | 52/546 X |
| 3,757,483 | 9/1973 | Torbett | 52/545 X |
| 4,054,012 | 10/1977 | Paradisi et al. | 52/519 X |
| 4,187,661 | 2/1980 | Poiry | 52/748.11 |
| 4,272,576 | 6/1981 | Britson | 52/519 X |
| 4,348,849 | 9/1982 | Wollam et al. | 52/545 |
| 4,411,117 | 10/1983 | Bolha | 52/748.11 X |
| 4,461,128 | 7/1984 | Knoebl | 52/748.11 X |
| 4,646,501 | 3/1987 | Champagne et al. | 52/520 |
| 4,854,101 | 8/1989 | Champagne | 52/520 |

*Primary Examiner*—Robert Canfield
*Attorney, Agent, or Firm*—Kuffner & Associates

[57] ABSTRACT

A system for covering an exterior surface of a building comprising a plurality of members for application to the building surface in a series progressing from one end of the surface to the other end in a first lengthwise direction. The system comprises at least two such members adapted to overlap in use, one of the members having, in the overlapping zone thereof, a first type connector comprising a lock formation defining a recess opening generally in the first direction. The other member has, in its overlapping zone, a second type connector comprising a hook formation having a free end projecting generally in the second lengthwise direction and into the recess in use.

9 Claims, 5 Drawing Sheets

1
2
5
6

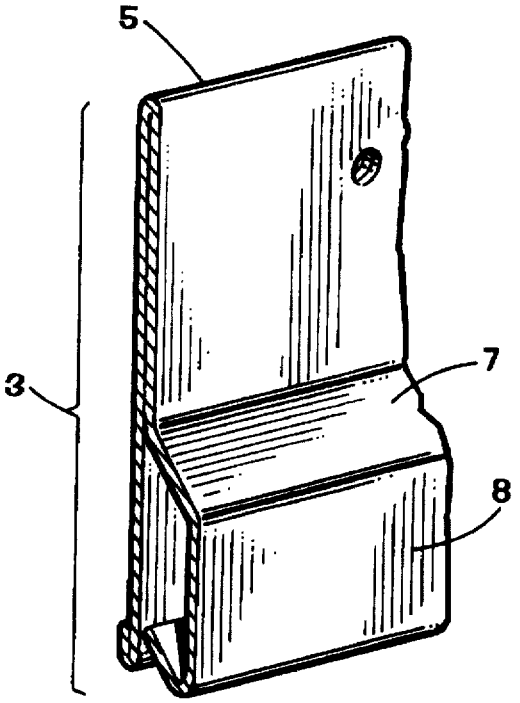
FIG. 2
FIG. 3
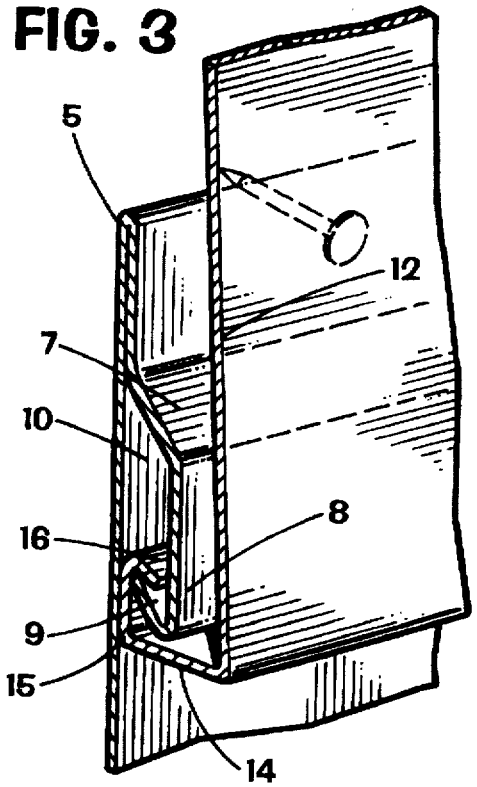
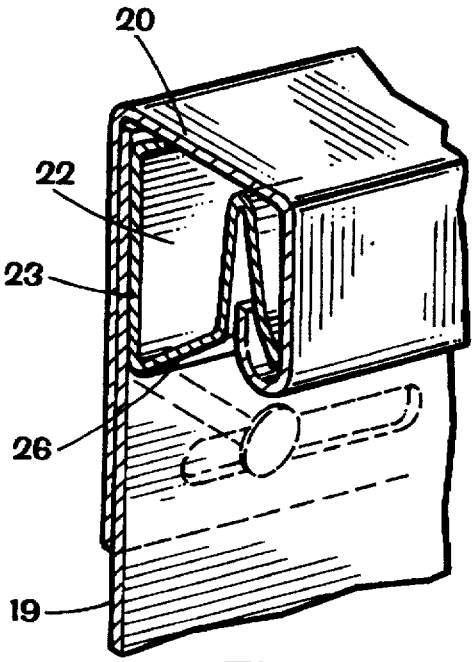
FIG. 4
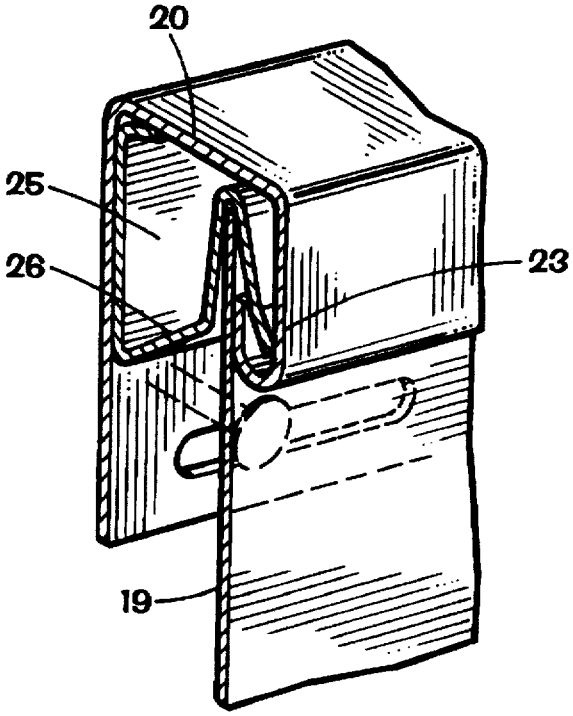
FIG. 5

SYSTEM FOR COVERING EXTERIOR BUILDING SURFACES

FIELD OF THE INVENTION

The present invention relates to a system and apparatus for covering the exterior surfaces of a building. More specifically, the present invention relates to an interlocking siding system for the walls and soffit of a building and to the protective structure installed according to the system, both preassembly and as assembled.

BACKGROUND OF THE INVENTION

For years, across the United States, homeowners and builders have used various forms of wood for the siding of their structures. However, because wood is highly susceptible to rotting and other adverse effects caused by harsh environmental and climatic conditions, it must be protected. Traditionally, this was done by painting, but more recently, property owners have increasingly used additional siding of aluminum, vinyl or steel to cover and protect the underlying wood siding and/or trim of their building. These products have generally provided suitable protection to the buildings, while maintaining a polished and new appearance.

Siding is generally installed from the bottom of the building toward the top. Typically, individual panels are nailed to the sides of the building, with each successive horizontal row of panels overlapping the row beneath it, until the siding reaches the top of the wall. However, because siding panels come in standard sizes, it is rare that the panel siding is an exact fit to the wall to which it is being affixed. As a result, when the installer of the building siding reaches the top of the wall, the top portion of the last row of panels usually must be cut or altered to fit the appropriate height of the building. This step most often includes cutting off the nailing hem of the siding panel, resulting in an unfinished edge with no ready means of direct attachment to the structure wall.

To rectify this problem, siding manufacturers and installers have developed many makeshift ways in which to attach the top portion of the siding to the building in such a manner that the polished look of the building is not marred. One of these methods is the use of a J-channel, a special end member developed by the siding industry, having a cross section in the shape of the letter "J". In this method, the cut edge of the siding panel is fitted with finish trim, or a separate nailing hem. The edge and finish trim are then secured within the J-channel to complete the finished look. However, because the finish trim is not the same width as the J-channel, this method sometimes leaves a noticeable gap between the J-channel and the finish trim.

Another method in which the top portion of the siding is affixed to the building is by "furring out" the siding within a J-channel. In this method, the installer places a random piece of material (any building excess or refuse found at the jobsite) behind the siding panel, forcing the siding panel to lie flush against the outer return of the J-channel. However, because this method of furring out allows for the use of different materials to force the siding panel against the J-channel, the siding panel may not always be evenly placed flush against the J-channel, causing an unsightly rippling effect on the building side. Further, it may be awkward to hold the "furr out" material in place.

The most difficult aspect of installing siding to a structure wall is ensuring that the siding panels remain horizontal as they are installed. This can prove difficult, as a small initial discrepancy in leveling the siding can mushroom, resulting in the final siding panel having a diagonal appearance. In order to prevent this from happening, several inventors have devised "interlocking" siding systems, designed to help position the panels while installing the siding. For example, U.S. Pat. No. 4,334,396 to John G. Hagopian, discloses a system in which each successive row of panels to be installed is attached to the previously installed row by means of built-in, snap-like "gripping portions" that connect the panels at their bottom and top edges. However, in order for the system of this patent to perform as intended, tension must be applied to the connection, either through the use of nails, or by the installer as the panels are being installed. Thus, the gripping portions of Hagopian do not independently support the panels during installation, allowing for undesirable displacement at one end of the panel or the other, and resulting in the necessity for the removal of the panels for re-installation. This removal can cost the contractor and the building owner additional time and cost to the siding project.

Further, while the Hagopian can be snapped together, they also can be easily pulled apart. In other words, these panel gripping portions hold the panels together only loosely, and the panels are easily compromised. During weather in which there is a large mount of wind, they even may be tom from the side of the building. Therefore these gripping portions act, at best, only as a means to temporarily help position the siding panels as they are nailed onto the wall, and provide no additional structural support for the assembled siding once installation has been completed.

Because of the problems which have been associated with traditional methods of installing protective siding, there has remained a need for a strong, sturdy protective siding system. It is desirable that installation be easy, while ensuring that any interlocking aspect of the system is not compromised during periods of high winds or other adverse weather conditions. Preferably, such a system should not only restrict the vertical movement of the siding panels, but also allow for expansion and contraction of the panels when temperature conditions change, in order to assure that the panels remain properly in place and do not warp or buckle.

SUMMARY OF THE INVENTION

The present invention comprises a system and method for covering an exterior surface of a building, such as an exterior wall or a soffit. The apparatus includes plurality of covering members for application to the building surface in a series progressing from one end of the surface to the other in a first lengthwise direction. In a typical application of covering members in the form of siding to a vertical wall the "one end" will be the lower end of the wall and the "first lengthwise direction" will be vertically upward.

A first of the covering members has a first connector adjacent a "distal end" thereof, i.e. near that end of the member which lies farthest from the one end of the building surface in use. A second of the covering members is adapted to overlap the first member and extend therefrom in the first lengthwise direction. The second member has a second connector adjacent a "proximate end" thereof., i.e. the end thereof which lies closes to the one end of the building surface in use, and which proximate end overlaps the distal end of the first member.

The first and second connectors are adapted to connect upon relative movement of the second connector toward the first connector in the first lengthwise direction. They are further adapted to lock upon attempted relative movement of the second member with respect to the first member in a second direction opposite to the first direction. Thus, not only are they less likely to become disconnected by high winds or the like, but in a typical vertical siding application, wherein the "second direction" is vertically downward, the locking which occurs upon attempted movement of the second member in this second direction, i.e. due to the force of gravity, allows the first member to actively or positively support the second member in proper alignment. In preferred embodiments, the connectors are further adapted so that, once connected, they lock upon attempted relative movement in either lengthwise direction, thereby further ensuring against accidental disconnection, e.g. in high winds.

In another aspect of the present invention, there is a terminal covering member for disposition adjacent, i.e. near, the "other" end of the building surface. In a typical wall siding application, this terminal covering member would be the uppermost piece of siding, and as implied above, the "other" end of the building surface would be the upper end. This terminal covering member has a flattened free end portion extending toward the other end of the building surface.

An end member has an inner portion for attachment to the building surface, a spacer portion projecting from the inner portion outwardly away from the building surface, and an outer portion extending from the spacer portion in the second lengthwise direction (downward) in a spaced relation to the inner portion. A resilient bridging member is adapted to interlock with the end member and includes a filler portion generally bridging the space between the inner and outer portions of the end member. This bridging member at least partially defines at least one slot for sliding receipt of the free end portion of the terminal covering member. This provides a more reliable way of imparting an attractive finished appearance to the upper edge of the siding.

In preferred embodiments, the apparatus is adapted so that two slots are defined, whereby the free end of the portion of the terminal covering member may be installed adjacent either the inner or outer portion of the end member, depending upon the look desired.

The manner in which the connectors of the siding or other covering members connect to each other, and the manner in which the bridging member interlocks with the end member, have certain features in common, which comprise still another aspect of the present invention. More specifically, in either case, there are two members adapted to overlap in use. One of these members has, in the overlapping zone thereof, a first type connector comprising a lock formation defining a recess opening generally in the first direction. The other member has, in its overlapping zone, a second type connector comprising a hook formation having a free end projecting generally in the second lengthwise direction and into the recess in use.

A number of other salient features may be included in preferred embodiments of the invention. Indeed, one preference is for a system to include all three of the aspects generally described above.

Another preference is that the connectors be adapted to allow for thermal expansion and contraction of the members. For lateral expansion and contraction, this may be accomplished by leaving the recess of the lock formation laterally open. For the vertical or lengthwise direction, it may be accomplished by the tolerances of the connectors, when connected, and when their respective attached panels are attached to the building surface.

In the preferred forms of the invention, all of the members in question are monolithically formed of sheet-like material.

These and other objects, features, and advantages of the invention will be further elucidated by the following detailed description, the drawings, and the claims.

BRIEF DESCRIPTION OF THE DRAWINGS

FIG. 2 illustrates an isometric view of the base member.

FIG. 3 illustrates an isometric view of the interlocking connection of the base member and the first building panel.

FIG. 4 illustrates an isometric view of the bridging member with the terminal end piece inserted such that the bridging member acts as finish trim.

FIG. 5 illustrates a isometric view of the bridging member with the terminal end piece inserted such that the bridging member acts as a furr out piece.

DETAILED DESCRIPTION

The present invention seeks to accomplish all these goals through the use of a novel interlocking system for the installation of the complete siding system for any building. The system of this invention uses a strong, secure, interlocking mechanism, which will ensure that the panels remain affixed to the structure wall, as well as to each other, until removed with the use of a special tool, discussed more fully below. The interlocking mechanism of the present invention comprises siding panels, each having channel-like gripping members on their lowermost and uppermost edges, adapted to allow the entire system to freely expand and contract without buckling. Further, the system of this invention comprises a "furr out" piece, which, when used in conjunction with a J-channel, employs similar interlocking method for receiving the cut edge of the final siding panel on the building. The furr out piece provides a uniform appearance to the panel surface, while securing the panel edge within the J-channel.

Figure 1:
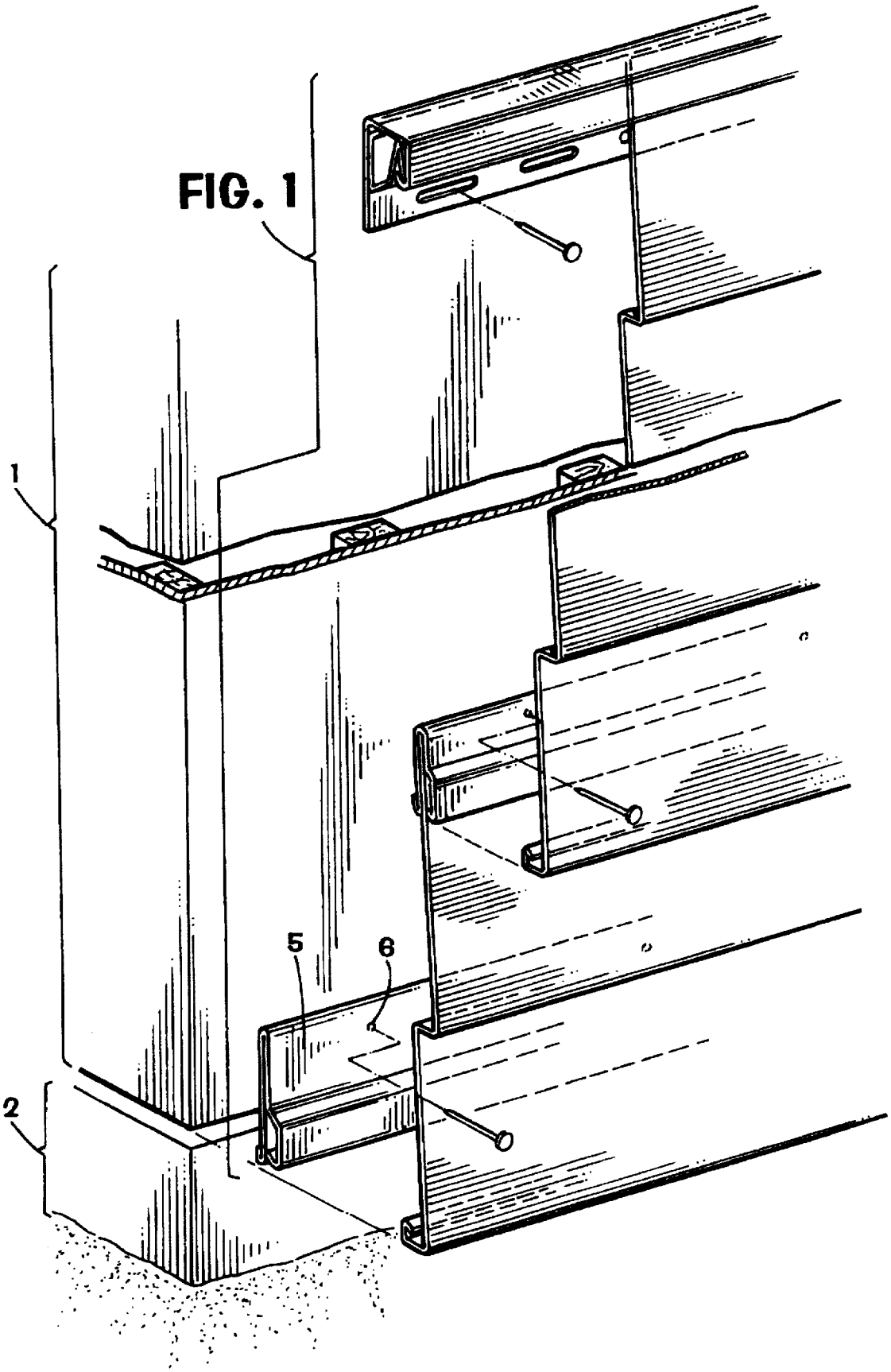
FIG. 1 details an isometric view of the system illustrating the interlocking connections between adjacent rows of siding panels.
Figure 8:
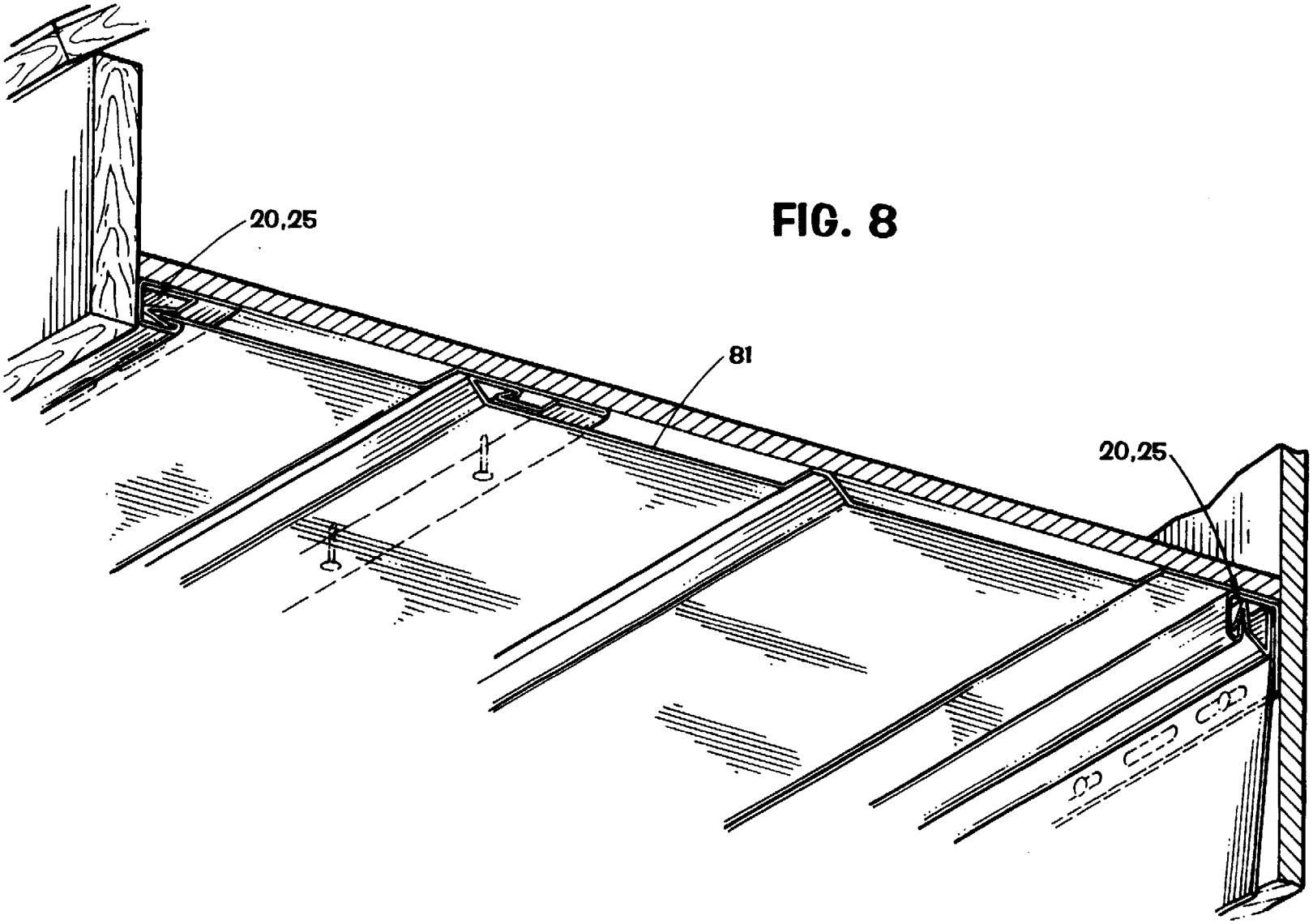
FIG. 8 illustrates an isometric view of the protective covering system as it would be applied to the soffit of a building.
Figure 9:
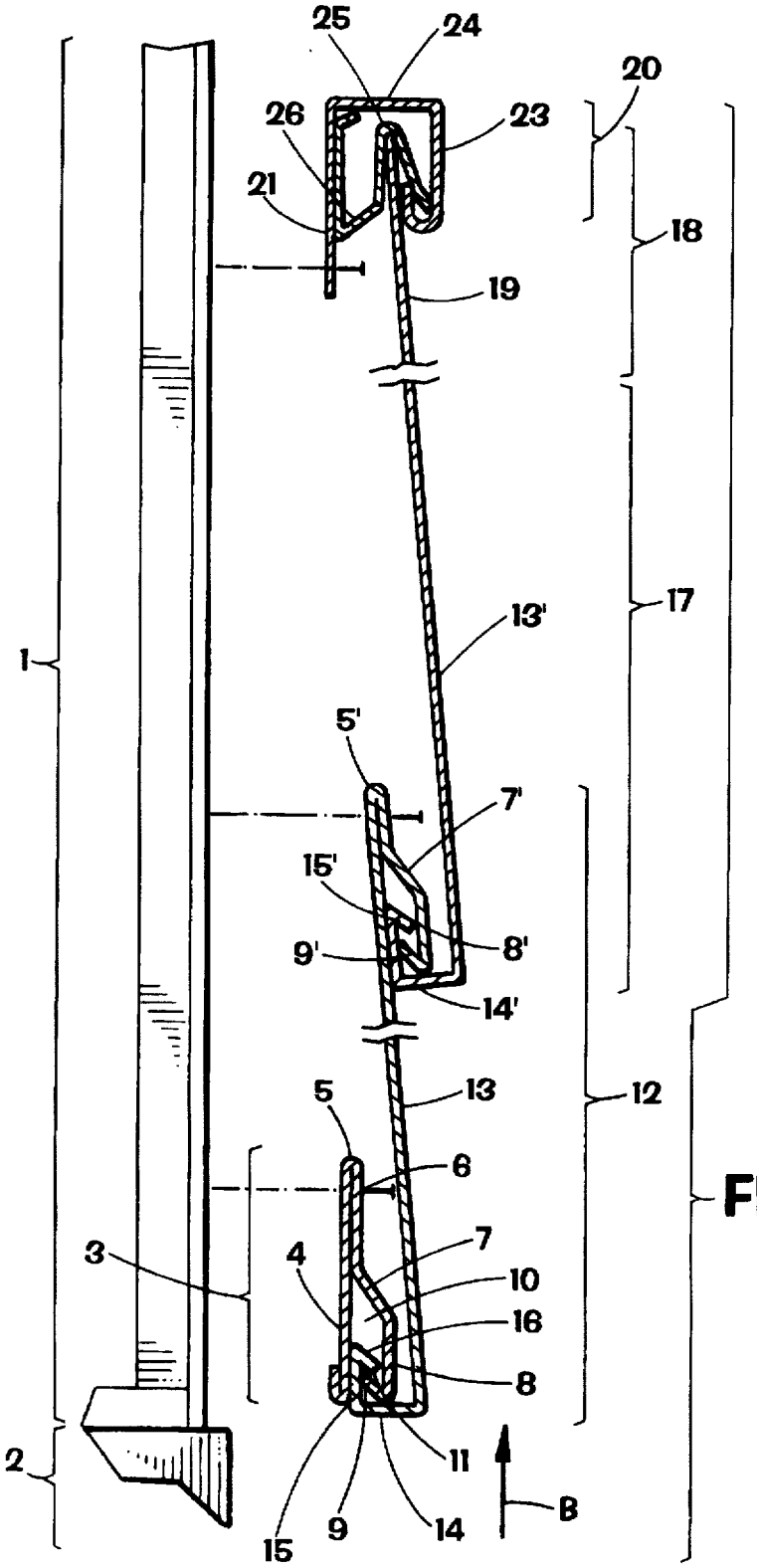
FIG. 9 illustrates a cross sectional view of the assembled system as the protective siding of a building including the base member, covering panels, and bridging member.

Referring to FIG. 9 in conjunction with FIG. 1, FIG. 2 and FIG. 8, there is shown a view of a typical installation of a system according to the present invention. More specifically, the system is shown as installed on a vertical building wall 1 extending upward from the foundation 2 of the building. The members of the system of the present invention are applied to the wall 1 in a series progressing lengthwise from one end, in this case the bottom, of the wall to the other end (top). It will be understood, however, that in other applications (for example, in soffit applications, as in FIG. 8), the series may progress from end to end in a horizontal or inclined direction. In the exemplary embodiment shown the vertically upward direction indicated by the arrow A will be considered the "first" lengthwise direction.

Installation in accordance with the present invention begins by first securing a primary "starter strip," or base member 3, to the bottom of the structure wall. Base member 3 is monolithically formed of a sheet-like material, such as aluminum or a suitable synthetic. It includes a planar innermost portion 4 extending from a free lower edge upwardly to lie flat against the wall 1. At the upper end of portion 4, the material is doubled back upon itself and extends downwardly to form a nailing hem 5 at the top of the member 3. The nailing hem 5 may have pre-formed holes, and is affixed to the wall 1 by nails 6. The base member is adapted to provide the first gripping member for the first row of siding panels to be installed at the lowermost portion of the wall. The adaptation occurs at the lower end of nailing hem 5, where the sheet-like material is inclined downwardly and outwardly away from portion 4 to form support element 7 of a first type of connector. From the outer edge of support element 7, the material extends downwardly to form an intermediate element 8 of the first connector, overlying but spaced from portion 4. Finally, from the lower edge of element 8 the material is turned back inwardly and upwardly as indicated at 9, its free edge terminating short of portion 7 to define a gap 10 lying between element 8 and portion 4. Element 9 and the lower part of element 8 form a lock region of the connector, which in turn defines an upwardly opening recess 11 shielded between elements 8 and 9.

The lowermost covering member 12 of a plurality of identical covering members, specifically siding members, is then connected to base member 3 in a manner best understood by reference to FIG. 9 in conjunction with FIG. 3. The member 12 has a main body or panel portion 13 for covering the wall surface 1. Panel portion 13 may have corrugations to simulate wooden planks. At its lower end, the member 12 has a second type connector adapted to interlock with the first connector 7, 8, 9. The lower end of member 12 will be referred to as its "proximate" end, because it is the end which lies closest to the one end, or lower end of wall 1, from which the series progresses. At this lower end, the panel 12 overlaps the base member 3, and specifically, its first connector 7, 8, 9. The second connector includes a spacer element 14 extending inwardly toward the building from the lower edge of panel 12, a portion 15 extending upwardly from the inner edge of spacer 14, and a portion 16 inclined outwardly and downwardly from the upper edge of portion 15. Together, portions 15 and 16 form a hook.

As shown in FIG. 9, the thickness (inward-outward dimension with respect to the wall) of the hook 15, 16 is greater than that of the gap 10. However, the support element 7 has sufficient resilient flexibility so that, when the hook 15, 16 is positioned below the gap 7 and the member 12 is then urged upwardly as indicated by the arrow B, the correspondingly inclined surfaces of portions 9 and 16 of the two connectors, respectively, will cam the first connector 7, 8, 9 outwardly, allowing the hook 15, 16 to pass through gap 10, 4, 8. The first connector 7, 8, 9 will then spring back into place, whereupon the free end portion 16 of hook 15, 16 will extend generally downwardly into the recess 11 as shown in FIG. 9.

Therefore, the base member's gripping member is engaged by the interlocking gripping member which is built into the lowermost portion of the standard siding panel, thus forming a permanent grip that locks the two engaging pieces together in two directions, but allows for movement in the third (lateral) direction. If it is attempted to move member 12 downwardly, the connectors will lock to resist the movement, since portion 16 extends downwardly into the upwardly opening recess 11. In addition to providing a very firm and sturdy connection which will not be dislodged by high winds or other inclement weather, this allows member 12 to hang on, and be supported by, member 3 during installation. Furthermore, because the members and their connectors are made of sheet material, and thus laterally elongated, the interengaged connectors also properly position member 12 parallel to member 3.

The connectors are dimensioned so that some vertical play between the members 3 and 12 is permitted to compensate for thermal expansion and contraction in the vertical direction. Also, because the recess 11 is laterally open, thermal expansion and contraction in the lateral direction is also permitted.

It will also be appreciated that the connectors 7, 8, 9 and 13, 14, 15 lock not only upon attempted downward movement of member 3 relative to member 12, but also upon any relative upward movement, such relative upward movement being limited by abutment of element 8 with element 14. This further ensures against accidental disconnection after installation.

The lower gripping member of the next row of siding panels is then engaged with the uppermost gripping member of the first row of siding panels, and the process is repeated with subsequent levels of siding, until the top of the building wall is reached. This process is further illustrated in FIG. 9. At its upper or "distal" end (that is, the end farthest from the bottom of wall 1), siding member 12 is formed identically to base member 3. Thus, it has an uppermost nailing hem 5' and a first type connector 7', 8', 9'. As such, an identical siding member 17 having a second type connector 13', 14', 15' at its lower end can be connected to member 12 in like manner as member 12 was connected to base member 3. Additional siding members are applied until a terminal siding member 18, reaching the top of the wall 1, has been hung on the next lowest siding member. The upper or first type connector and nailing hem are cut off of member 18, leaving a flattened, upwardly extending, free end 19.

Note that the nailing hem included on each individual siding member is for the purpose of "tacking" the panel to the wall. In the present invention of this system, the nail does not provide any tension or structural support to the system, as all structural support is provided by the actual gripping connection between engaging panels.

In the event the panels must be removed from the building wall 1, a special tool must be employed designed specifically for this purpose. This tool consists of a flat handle with two protrusions, one above the other on the upper third of the handle, having a width generally equal to the width of the handle. For removal of the panel from the building wall 1, the first protrusion of the tool is inserted into the seam created by an upper and lower panel 12, 17. This first protrusion pushes against the nail hem 5' of the lower panel 12, forcing the lower panel 12 away from the upper panel 17. The second lower protrusion then grasps the hook of the upper panel 17 and pulls the upper panel 17 away from the wall.

Figure 6:
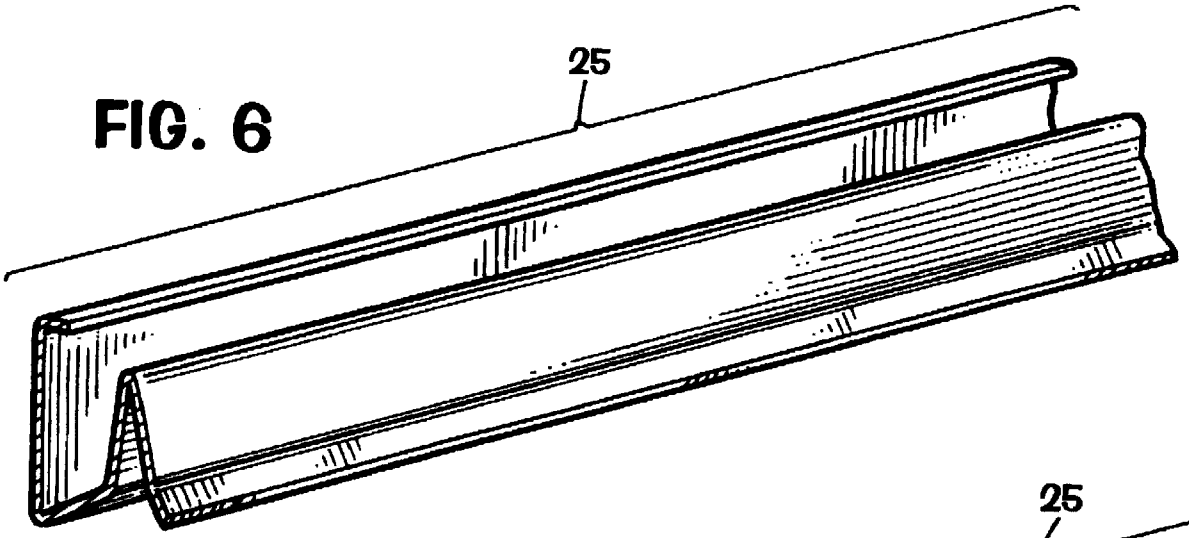
FIG. 6 illustrates one embodiment of the bridging member before snapping into the end-piece.
Figure 7:
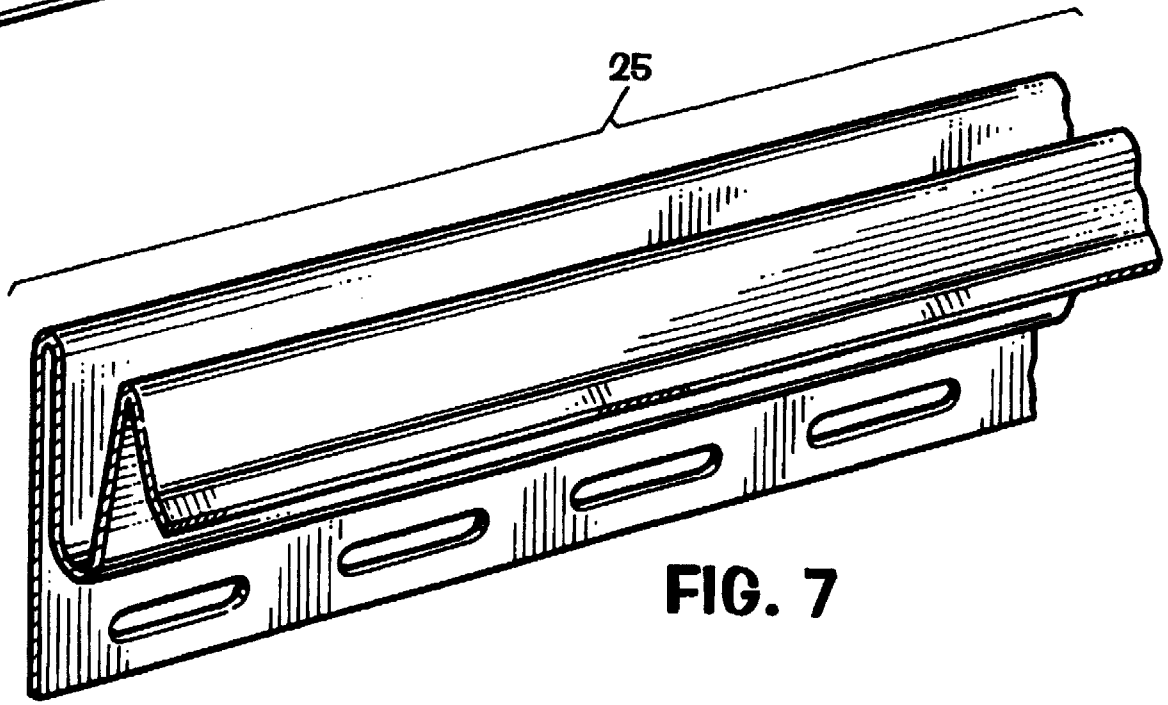
FIG. 7 illustrates a second embodiment of the bridging member, having a nailing hem, before snapping into the end piece.
Figure 10:
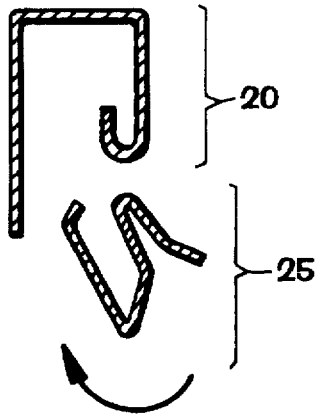
FIG. 10 details a cross sectional view of the bridging member and end piece, illustrating the manner in which the bridging member is rolled or snapped into the end piece.

Once the installer has reached the top of the building wall, in order to affix the cut edge of any panel to the wall, the present invention also provides for a specially adapted "furr out" piece, or bridging member, for simply and inexpensively securing the unfinished siding panel edge within a J-channel. This bridging member is detailed in FIG. 9, in conjunction with FIGS. 6 and 7. At the point of the building wall 1 where the final piece of siding is to be affixed, an end piece 20, shaped as a J-channel, attached to the building surface, preferably with the use of the nailing hem 21. The end piece 20 is attached such that its outer portion 23 stands away from, but parallel to, the building wall 1, due to the spacer portion 24. A specially adapted bridging member 25 is then interlocked with the end piece 20, by "rolling" and snapping this piece into the end piece 20, as illustrated in FIG. 10. Secured in the position shown in FIG. 10, the bridging member 25 acts in two separate ways. As seen in FIG. 4, in one instance, the bridging member 25 acts as finish trim, where the flattened, upwardly extending, free end 19, of the siding panel is inserted behind the bridging member 25, and in front of the inner portion 22 of the end piece 20. In this fashion, the filler portion 26 of the bridging member 25 becomes ornamental, and adds to the finished appearance of the top edge of the building wall 1. In a second instance, as shown in FIG. 5, the bridging member 25 actually "furrs out" the siding panel within the J-channel, where the flattened, upwardly extending, free end 19, of the siding panel is inserted in front of the flier portion 26 of bridging member 25, and behind of the outer portion 23 of the end piece 20. This method of securing the free end 19 of the siding panel ensures that it remains evenly flush against the outer portion 23 of the end piece 20.

While the invention has been described in detail with respect to specific preferred embodiments thereof, it will be apparent to those skilled in the art upon a reading of the foregoining that numerous variations may be made thereto without departing from the scope of the invention or the appended claims. For example, the panel coverings may be installed in any direction, either horizontally, vertically or diagonally along the building surface, or on any part of the building exterior. As an illustration of another embodiment of the present invention, FIG. 8 shows a soffit application, detailing the soffit panels 81, a base member 23, and an endpiece with the interlocking briding member 20, 25.

What is claimed is:

1. A protective covering system for application to the exterior surface of a building, comprising:

(a) a plurality of covering members having a panel surface for covering the exterior of the building;

(b) a horizontal base member having a planar portion extending vertically from a lower edge, said planar portion having an upper edge folded over and extending downwardly forming a nailing hem portion for securing said base member to the bottom of the building surface, a first angled surface extending downwardly from said hem portion and outwardly from said planar portion, a vertical surface extending downwardly from said first angled surface and spaced from said planar surface, and a second angled surface extending upwardly from said vertical surface toward said planar portion;

(c) each of said covering members having a lower locking flange at a lower edge thereof, said locking flange comprising a spacer element extending inwardly from the lower edge of said covering members and terminating at an upwardly extending vertical panel portion, said vertically extending panel portion having an upper edge folded over and extending angularly downwardly toward said spacer element forming a downwardly opening locking hook;

(d) each of said covering members further having an upper edge folded over and extending downwardly forming a panel nailing hem portion along said upper edge of said covering members, a third angled surface extending downwardly from said panel hem portion of said covering members and outwardly from the panel surface of said covering members, a vertical surface extending downwardly from said third angled surface and spaced from said panel surface, and a fourth angled surface extending upwardly from said vertical surface toward said panel surface;

(e) a horizontal end piece adapted to be mounted along the top of the exterior surface of the building defining a channel for receiving an upper edge therein of the uppermost of said covering members; and (f) a bridging member for retaining the upper edge of the uppermost covering members within the channel of said end piece.

2. The protective covering system of claim 1 wherein said vertical surface extending downwardly from said first angled surface and said second angled surface define a substantially V-shaped profile in cross-section.

3. The protective covering system of claim 2 wherein said locking hook defines an inverted substantially V-shaped profile in cross-section.

4. The protective covering system of claim 3 wherein said vertical surface extending downwardly from said third angled surface and said fourth angled surface define a substantially V-shaped profile in cross-section.

5. The protective covering system of claim 1 wherein said covering members are monolithically formed of sheet-like material.

6. A covering member for application to the exterior surface of a structure in a progressive sequence from the bottom to the top of the structure, comprising:

(a) a panel surface having a lower locking flange at a lower edge thereof, said locking flange comprising a spacer element extending inwardly from the lower edge of said panel surface and terminating at an upwardly extending vertical panel potion, and said vertically extending panel portion having an upper edge folded over and extending angularly downwardly toward said spacer element forming a downwardly opening locking hook; and (b) said panel surface further including an upper edge folded over and extending downwardly forming a panel nailing hem portion along said upper edge of said panel surface, a first angled surface extending downwardly from said panel hem portion of said panel surface and outwardly from said panel surface, a vertical surface extending downwardly from said first angled surface and spaced from said panel surface, and a second angled surface extending upwardly from said vertical surface toward said panel surface.

7. The covering member of claim 6 wherein said locking hook defines an inverted substantially V-shaped profile in cross-section.

8. The covering member of claim 7 wherein said vertical surface extending downwardly from said first angled surface and said second angled surface define a substantially V-shaped profile in cross-section.

9. The method of installing a protective covering on an exterior surface of a building, comprising:

(a) affixing a horizontal base member to the bottom of the building surface, said base member having a planar portion extending vertically from a lower edge, said planar portion having an upper edge folded over and extending downwardly forming a nailing hem portion for securing said base member to the bottom of the building surface, a first angled surface extending downwardly from said hem portion and outwardly from said planar portion, a vertical surface extending downwardly from said first angled surface and spaced from said planar surface, and a second angled surface extending upwardly from said vertical surface toward said planar portion;

(b) overlapping said base member with a covering member comprising a panel surface having a lower locking flange at the lower edge thereof, said locking flange comprising a spacer element extending inwardly from the lower edge of said covering member and terminating at an upwardly extending vertical panel portion, and said vertically extending panel portion having an upper edge folded over and extending angularly downwardly toward said spacer element forming a downwardly opening locking hook for locking engagement with said second angled surface of said base member;

(c) wherein said covering member further includes an upper edge folded over and extending downwardly forming a panel nailing hem portion along said upper edge of said covering member, a third angled surface extending downwardly from said panel hem portion of said covering member and outwardly from the panel surface of said covering member, a vertical surface extending downwardly from said third angled surface and spaced from said panel surface, and a fourth angled surface extending upwardly from said vertical surface toward said panel surface;

(d) supporting said covering member in locking engagement with said base member and affixing the panel hem portion of said covering member to the building surface;

(e) overlapping the upper edge of said covering member with a second covering member and interlocking said covering member with said second covering member; and (f) repeating steps (a) through (e) until the building surface is completely covered.

* * * * *